United States Patent [19]

Weigl

[11] 3,956,524

[45] May 11, 1976

[54] METHOD FOR THE PREPARATION OF ELECTROSTATOGRAPHIC PHOTORECEPTORS

[75] Inventor: John W. Weigl, West Webster, N.Y.

[73] Assignee: Xerox Corporation, Stamford, Conn.

[22] Filed: Dec. 4, 1974

[21] Appl. No.: 529,440

[52] U.S. Cl. ..... 427/40; 427/39; 427/41; 427/58; 427/108; 427/384; 427/385; 427/388; 96/1 PE; 96/1 C; 96/1.5

[51] Int. Cl.[2] ..... B05D 3/06; B05D 5/12

[58] Field of Search ..... 427/39, 40, 41, 58, 427/108, 384, 385, 388; 96/1 PE, 1 C, 1.5 R

[56] References Cited

UNITED STATES PATENTS

| | | | |
|---|---|---|---|
| 3,689,399 | 9/1972 | Ota | 96/1 PE |
| 3,689,400 | 9/1972 | Ota et al. | 96/1 PE |
| 3,772,013 | 11/1973 | Wells | 96/1 PE |
| 3,775,104 | 11/1973 | Matsumoto | 96/1 C |
| 3,804,659 | 4/1974 | Sato et al. | 427/39 |
| 3,850,630 | 11/1974 | Regenburger | 96/1.5 |
| 3,877,935 | 4/1975 | Regenburger | 96/1.5 |

*Primary Examiner*—Michael F. Esposito
*Attorney, Agent, or Firm*—James J. Ralebate; James P. O'Sullivan; Jerome L. Jeffers

[57] ABSTRACT

Disclosed is an improved method for the preparation of an electrostatographic photoreceptor comprised of a layer of an organic active transport or insulating material overcoating a layer of a photoconductive material in operative connection with a conductive substrate. The method involves preparing a uniform liquid dispersion of the organic material in an appropriate solvent as a carrier phase having a pigmentary photoconductive material dispersed in it as a dispersed phase. The liquid dispersion is coated onto a conductive substrate and exposed to a direct stream of corona ions or a high intensity DC electric field, without contacting its surface with an electrode, to cause separation of the two phases into a two layered structure with the layer of photoconductive material being deposited between the substrate and the solution of organic material. Drying the structure by removing the solvent for the organic material provides the finished photoreceptor.

20 Claims, 5 Drawing Figures

METHOD FOR THE PREPARATION OF ELECTROSTATOGRAPHIC PHOTORECEPTORS

BACKGROUND OF THE INVENTION

This invention relates to the art of electrostatographic copying and more specifically to a novel method for the preparation of a photosensitive device.

In the art of electrostatographic copying, a plate comprising a photoconductive insulating layer is electrostatically charged in the dark in order to apply a uniform charge to its surface. The charged plate is then exposed to activating radiation in imagewise configuration to selectively dissipate the charge in the illuminated areas while leaving behind a latent electrostatic image corresponding to the non-illuminated areas. The latent image is then developed by depositing finely divided electroscopic marking materials on the surface of the plate. This concept, which was originally disclosed by Carlson in U.S. Pat. No. 2,297,691, has been further amplified in many related patents in the field.

Conventional xerographic plates usually comprise a photoconductive insulating layer overlaying a conductive substrate. A photoconductive material which has been widely used as a reusable photoconductor in commercial xerography comprises amorphous selenium.

An improved type of photoreceptor useful in electrostatographic copying comprises an electrically conductive substrate having on its surface a relatively thin layer of light absorbing photoconductive charge carrier generating material overcoated with a relatively thick layer of substantially transparent, organic, active transport material. This type of photoreceptor is advantageous due to its increased flexibility and the protection from physical damage afforded the photoconductor by the overlayer of active transport material. In addition, this configuration facilitates the use as carrier generators of photoconductive materials which are too conductive in the dark for use in conventional single layer photoreceptors. Another type of photoreceptor which has come into use in recent years comprises a conductive substrate having a layer of photoconductive material on its surface which is overcoated with an electrically insulating organic material.

The usual method of preparing a photoreceptor having a layer of photoconductive material overcoated with an organic material (either active transport or insulating) involves applying the layer of photoconductive material to the substrate, such as by vapor deposition of selenium, and then applying a solution of the organic overcoating material to the photoconductor surface. Evaporation of the solvent, which is normally carried out at an elevated temperature, leaves an adherent, continuous layer of the organic overcoating material.

This two step procedure has several drawbacks. First of all, it is relatively cumbersome and expensive since two separate coating steps are needed, each requiring separate control of deposition and coating thickness. Furthermore, the second coating step must be such as not to disturb the first layer, e.g. by re-solution, re-crystallization or mechanical disturbance thereof. Since the second coating material must be applied from a solvent which does not disturb the first layer, it is difficult to avoid formation of an electrical barrier between the dielectric layers, which barrier may act to impede the free flow of electrical charge carriers between these layers. In addition, since an additional interface is present, there may be considerable difficulty in adhering the final coating to the photoconductive sub-coating.

It would be desirable and it is an object of the present invention, to provide a novel method for the preparation of an electrostatographic photoreceptor comprising a conductive substrate, a layer of a photoconductive material and an overcoating layer of an active transport or insulating organic material.

It is another object to provide a novel single step process for applying two layers to a conductive substrate in a well-controlled manner.

It is another object to provide a coating process for applying simultaneously a photoconductive pigmented carrier generator layer dispersed in an "active" organic binder and an overlaying "active" transport layer consisting essentially of the same "active" binder material without a significant proportion of the pigmentary photoconductive material.

A further object is to provide a coating process for the simultaneous deposition of a mixture of two or more photogenerating photoconductive pigments in a single layer overcoated by an active overcoating.

An additional object is to provide a process for the simultaneous deposition of a relatively thin photoconductor-binder layer and a relatively thick photodischargeable protective layer therefore.

A further object is to provide a simplified fabrication method for the double layer photoconductor/dielectric photoreceptors used for the charge-recharge processes of Hall, Canon and Katsuragawa as described in *Photographic Science and Engineering;* Vol. 18, No. 3, May/-June 1974 (pp. 254–261).

SUMMARY OF THE INVENTION

The present invention is an improved method for the preparation of an electrostatographic photoreceptor comprised of a layer of an organic active transport or insulating material overcoating a layer of a photoconductive, charge carrier generating material in operative connection with a conductive substrate. The method comprises:

a. selecting at least one organic active transport or insulating material and at least one pigmentary photoconductive material;

b. preparing a substantially uniform liquid dispersion containing the pigmentary photoconductive material as dispersed phase and the organic, active transport or insulating material in solution with a solvent therefore as carrier phase;

c. uniformly coating the dispersion onto a grounded conductive substrate in such a manner that the buildup of electrostatic fields in the dispersion is avoided;

d. exposing the liquid coating to a direct stream of corona ions or a high intensity DC electric field, without contacting its surface with an electrode, in order to cause separation of the two phases into a two layered structure with the layer of photoconductive material being deposited between the substrate and the organic material in solution; and e. drying the layered structure by removing the solvent.

DETAILED DESCRIPTION AND PREFERRED EMBODIMENTS

Figure 1:
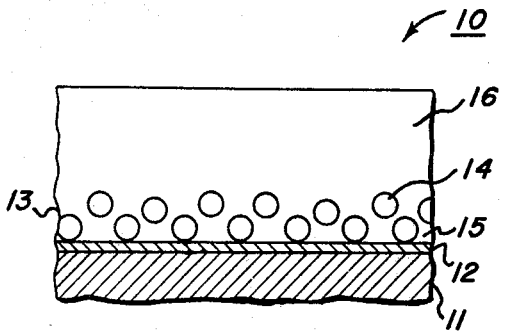
Figure 2:
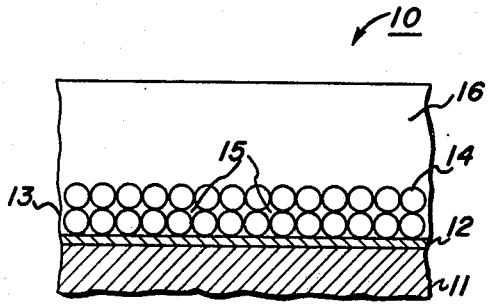

For the sake of clarity, the invention shall be described first for that embodiment in which a two layer "active matrix" photoreceptor is formed. Such photoreceptors have been described by Regensburger in co-pending application Ser. No. 341,813. As shown in FIG. 1, such a photoreceptor, generally designated as 10, consists typically of a conductive base 11, which is, for example, a metal, a metallized plastic film or a tin oxide coated glass plate. Next, optionally, is a thin blocking interface 12 such as a 0.01 to 0.3 $\mu$ thick insulating metal oxide or dielectric plastic film. Above the blocking interface is a photoconductive charge generating layer 13 comprising the photoconductive charge carrier generating pigment particles 14 dispersed in a matrix 15 of an electrically active organic material. The photoreceptors prepared by the process of the instant invention will necessarily contain at least a small amount of the organic overcoating material in the charge generating layer since the material will not be totally displaced by the deposited photoconductive pigment. The charge generating layer depicted in FIG. 1 contains a fairly small amount of pigment which is randomly dispersed. Another embodiment is illustrated by FIG. 2 wherein the pigment 14 is highly concentrated and forms a continuous layer within matrix 15. The photoconductive charge generating layer 13 is capable of generating electronic charge carriers in response to the absorption of visible radiation to be recorded by the imaging photoreceptor, and is overcoated with an organic "active" dielectric overcoating 16 which will necessarily comprise the same material as the matrix 15 and which is capable of transporting charge carriers which have been photogenerated in the photoconductive layer and injected into the transport layer by means of an externally applied electric field. This type of photoreceptor and its method of operation is more fully described in several scientific publications such as Regensburger, *Photochemistry and Photobiology*, Vol. 8, p. 429 (1968) and Weigl, *Photochemistry and Photobiology*, Vol. 16, p. 291 (1972). As is pointed out in those articles, in order to be most effective, the active transport layer 16 should be substantially transparent to a large portion of the spectral sensitivity range of the carrier generator layer 13. Even though actinic absorption in the transport layer 16 may contribute to a minor extent to the photosensitivity of the entire device 10, this is generally not desirable since the efficiency of carrier generation is generally greater in the strongly visible-light absorbing photoconductor materials selected for use in the generating layer 13.

As used herein, the term active transport material is intended to include an organic polymer or non-polymeric material capable of supporting the injection of photoexcited holes or transporting electrons from the photoconductive material and allowing the transport of these holes or electrons through the organic layer to selectively dissipate a surface charge. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole) (hereafter designated as PVK); poly(vinylpyrene); poly(-vinyltetraphene); poly(vinyltetracene) and poly(vinylperylene). Suitable electron transport materials include electron acceptors such as 2,4,7-trinitro-9-fluorenone (hereafter designated as TNF); 2,4,5,7-tetranitrofluorenone; dinitroanthracene; dinitroacridene; tetracyanopyrene and dinitroanthraquinone.

Charge transfer complexes of electron donors and acceptors may also be used to good advantage. All the above-listed materials may be used as binder-free layers, or in polymeric binder solution or dispersion, the latter generally comprising over 30% by volume of active transport material in an otherwise inert polymeric binder.

Typical non-active binder materials include polycarbonates, acrylate polymers, poly amides, polyesters, polyurethanes and cellulose polymers. Generally, a non-active polymeric binder is employed where it is desired to improve the mechanical properties of the active transport layer. A photoreceptor having a layer of an active transport material dispersed in a non-active binder is prepared by the same general technique as those having a homogeneous active transport layer except that both organic materials (the active transport material and the non-active binder) are dissolved in the solvent. Forcing the photoconductive pigment particles to the bottom of the layer by the technique disclosed herein with subsequent removal of the solvent will then provide the finished photoreceptor.

The pigmentary photoconductive carrier generating material used in layer 13 may consist of any suitable organic or inorganic photoconductor which is capable of the photogeneration of hole-electron pairs. Typical inorganic materials of this type include both crystalline compounds and vitreous materials typically based on chalcogenes such as selenium and tellurium and their alloys. Mixtures of such materials may be used where suitable. Exemplary of suitable inorganic materials are cadmium sulfide, cadmium sulfoselenide, cadmium selenide, crystalline and amorphous selenium, lead oxide and other chalcogenides. Typical organic pigmentary photoconductors include phthalocyanine pigments such as the X-form of metal free phthalocyanine (hereafter designated "$H_2Pc$") described in U.S. Pat. No. 3,357,989 and metal phthalocyanines such as copper phthalocyanine. Other suitable organic photoconductive pigments such as bis-benzimidazole pigments, perylene pigments, quinacridone pigments and indigoid pigments may be used. The preceeding exemplative summary of photoconductors should in no way be taken as limiting, but is merely illustrative of suitable materials. As is clear from the references cited above (particularly the Weigl publication), one may choose appropriate pigments to suit the desired spectral sensitivity range and the appropriate pigment/active transport matrix combination to suit the polarity of charge to be applied in xerographic use.

As the aforementioned references make clear, negative charge is generally to be applied to the double layer active matrix photoreceptors based on an "active" hole transport matrix overcoating and positive charge to such photoreceptors overcoated with an "active" electron transport material. When the "active" matrix comprises approximately equal components of electron acceptor and donor, it may be possible to use the resultant photoreceptor with either positive or negative charge. The principles for such selection are well known to those skilled in the photoreceptor art, and need no further elaboration here. Finally, it may be pointed out that it may be advantageous to use mixtures of photoconductive pigments in the photogenerating layer, e.g. to achieve an extension of spectral response or photosensitivity range.

The first step in carrying out the method of the instant invention involves the selection of at least one each of a photoconductive material and an organic active transport material. Those photoconductors having affinities for corona ions can be forced to acquire an electrostatic charge by the introduction of an external source of ions.

Table I lists an illustrative series of pairs of materials which may be used to form double layer active matrix photoreceptors by the coating process of the instant invention. There is, of course, a nearly unlimited series of alternative operative material combinations.

TABLE I

| Pigmentary Photoconductor (Charge Generator for Layer 13) | Active Matrix Material | Transport Type | Preferred Surface Charge Polarity |
|---|---|---|---|
| Trigonal selenium | PVK | Holes | Negative |
| x-$H_2$Pc | 80 mol% PVK: 20 mol% TNF | Ambipolar | Positive or Negative |
| CdS/Se | 40 vol% TNF in Lexan polycarbonate resin | Electrons | Positive |
| x-$H_2$Pc | 40 vol% triphenylamine in Lexan polycarbonate resin | Holes | Negative |

Alternatively, a mixed grain photoconductor such as, for example, trigonal selenium and x-$H_2$Pc may be used.

The pigmentary photoconductor is dispersed in a solvent solution of the active transport material and coated uniformly on substrate 11 or, if a dielectric interface 12 is used, on the latter. Typical coating methods include brushing, dipping, spraying, gravure coating, Mayer bar, and "Bird blade" coating techniques. All of these techniques are well known to be capable of applying relatively uniform layers in the 10 to 50 micron wet film thickness range. The application of thinner or thicker layers can, of course, be readily achieved where desired.

Suitable solvents for the organic active transport material are those organic liquids which will dissolve the material and do not react detrimentally with it or the pigmentary photoconductive material. In addition, the solvent should be sufficiently volatile to be easily evaporated from the system. Typical solvents include toluene, cylcohexanone, chloroform, tetrahydrofuran, benzene, dioxane and methylene chloride. Of course, some routine experimentation may be required to match the best solvent with the particular organic material being dissolved. It will also be necessary to select a solvent for the organic active transport material which is substantially a non-solvent for the photoconductor.

The next step in the process of the instant invention involves subjecting the newly deposited uniform slurry to a high voltage, direct current corona discharge, e.g. from a corotron wire, scorotron device or an array of closely spaced sharp corona emitting points. Such devices are well known and are described by Dessauer and Clark in *Xerography and Related Processes*, New York, Focal Press, 1965. When raised to an appropriate voltage, for example 4 to 10 kilovolts, such devices share the ability to emit corona ions as a glow discharge across an air gap.

The corona electrode may be provided in the form of a corotron, i.e. a grounded metal shield having blocks of an insulating material at each end, one of the blocks being modified with a probe extending from it. A wire is suspended between the two insulating blocks and electrically connected to a metal pin in the probe. The wire is held parallel to the sides of the shield by its mounting hardware. In operation, the corotron is placed in close proximity (but not in contact with) the liquid layer containing the dispersed photoconductive material. When the photoconductive material is such that it can be induced to carry a positive charge, a strong positive potential is placed on the corotron wire. This positive charge causes electrons to move to the inner surfaces of the shield from ground, and as electrons move to the inner surface, the electrostatic field intensifies between the shield and the wire. Air contains a number of free electrons, and these electrons are pulled toward the wire. As the electrons accelerate they collide with air molecules and thereby displace electrons forming positive ions. The displaced electrons, in turn, collide with other atoms, and the process is repeated until the area around the wire is saturated with positive ions. The movement of the positive ions of air is from the wire towards the shield or any grounded surface close to the corotron which, in the case of the coating process of this invention, is the conductive backing 11 of the photoreceptor device 10 being prepared. Thus, they will move to the surface of the liquid layer.

As the positive ions come in contact with the shield or grounded surface, they acquire electrons and their charge is neutralized. The electron path or flow is from ground to the ion cloud to the corotron wire back to the power supply. More current flows from the shield to the corotron wire than from the grounded plate to which the charge is being applied. This heavy current between the wire and the shield is necessary if the desired output of the corotron, which is a uniform cloud of ions, is to be achieved. This design also insulates the ion current to the wire from sudden changes caused by an external electrostatic field.

When negative voltage is applied to the wire, electrons are emitted, forming negative ions. Movement of negative ions is from the wire to the shield or any grounded surface.

Figure 3A:
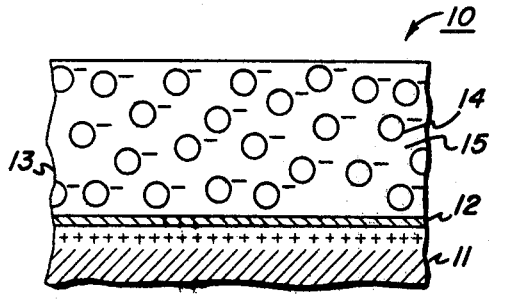
Figure 3B:
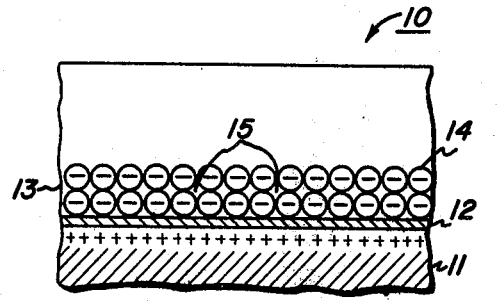

As the ions impinge the coating slurry on their way to the conductive base, it has been discovered that they tend to be selectively trapped or adsorbed by the dispersed pigmentary photoconductive particles. These particles thereby become strongly charged and are forced down through the coating mixture to the interface 12 or the grounded conductive base 11 beneath the interface. The resin solution, on the other hand, is sufficiently fluid to allow the corona ions and the solution ions generated thereby to flow freely through to the base, without appreciable deposition of resin. The pigment is thus electrophoretically precipitated to the bottom of the liquid coating to the base with only a relatively minor percentage of the resin being adsorbed thereto. The substantially pigment free resin solution remains above the pigment layer. This aspect of the invention is illustrated by FIG. 3*a* which shows, in exaggerated form, the state of pigment dispersion in the wet film before its precipitation by corona treatment. Precipitation of the pigment particles produces a photoreceptor as illustrated in FIG. 3*b*. Particle migration is found to be very fast and is generally completed within 1 to 5 milliseconds of the first effective impact of the corona ions. The precipitation process is thus surprisingly fast, efficient and complete.

The volatile solvent is now evaporated by conventional means, and, if desired, the completed photoreceptor may be further dried to remove the last solvent residue by the application of heat and/or vacuum. It is then ready for use in the xerographic imaging process.

Although the above description emphasizes the action of newly added corona charge, and the action of such charge is strongly predominant in forcing the precipitation of the pigment layer, pre-existing particle charge may also contribute to the desired effect. For example, phthalocyanine particles in insulating liquid dispersions tend to bear a positive charge relative to the distributed counter-ions in the solvent slurry. Therefore, when this is the case, positive corona discharge would preferably be used to precipitate such particles. The opposite is sometimes true of certain types of cadmium sulfide or cadmium sulfoselenide particles having excess negative surface ions. Thus, the photoconductive particles 14 in FIGS. 3*a* and 3*b* are depicted as carrying a negative charge both before and after precipitation. Such particles would be most readily precipitated by negative corona ions. In general, pre-existing net charge on the particles is largely determined by the overall chemical composition of the slurry, and a preliminary electrophoretic measurement should be made on any new material to determine the predominant particle charge prior to selection of optimal corona polarity.

From the above discussion, it can be determined that the suspended pigment particles can be driven to the bottom of the liquid layer by introduction of corona ions. When the particle carries a pre-existing charge, the introduction of corona ions carrying the same charge as the suspended particle will cause its precipitation due to the mutual repulsion of like charges. Thus, by the application of a high-intensity positive DC field to the surface of the liquid dispersion when the suspended photoconductive particles bear a positive charge, the photoconductive material will be driven down to the substrate with the result being a two layered coating on the substrate comprising a layer of photoconductive material overcoated by a layer of the solution of the organic material. Conversely, the application of a negative DC field would achieve the desired result in the situation where the suspended photoconductive material carried a negative charge.

It is essential that the application of the DC field to the surface of the dispersion be done without contacting the surface with an electrode. Surface contact must be avoided in order to prevent mechanical disturbance of the layer surface, or its electrophoretic pickup by the electrode. This is conveniently accomplished by the use of the corotron device previously described to provide a cloud of ions which move toward the grounded base electrode. The base electrode may be integral with the substrate; or be a grounded roller, belt or other suitable member placed behind the latter.

As previously mentioned, the last stage in preparation of the photoreceptor by the process of the instant invention is that of drying the liquid layer. Upon drying the layer by removal of the solvent, a solid two layered structure is obtained comprising a layer of photoconductive material overcoated with a layer of organic active transport material. Typically, the two layered structure will be applied to a conductive substrate such as brass, aluminum, steel, a metallized polymer or a conductively coated dielectric or insulator. The substrate may be of any convenient thickness, rigid or flexible and in any desired form such as a web, belt, plate, cylinder or drum. It may also comprise other materials such as aluminum or glass coated with a layer of chromium or tin oxide.

The three layered structure, i.e. conductive substrate, photoconductive layer and organic overcoating, can be made by applying the slurry directly to the substrate and causing the pigment particles to precipitate as previously described. They will adhere to the substrate due to the adhesion provided by that proportion of resin which attaches itself to the pigment. This embodiment is preferred for ease of operation as well as providing a structure in which the same resin present is in and above the pigment layer thereby adding to its integral adhesion as well as to good adhesion and transport properties. Alternatively, the precipitation can be carried out on a non-adhering substrate and stripped (after drying) with the stripped film then being attached to a conductive substrate by use of an appropriate adhesive. One could, if desired, invert the layer after striping to form a finished photoreceptor having the layer of pigmentary photoconductor overlaying the active transport layer.

Typically, a 6 KV scorotron with a 500 V screen potential projecting corona ions through, for example, a mask with a 1 centimeter wide opening, is capable of delivering about 50 microamperes of ion current comprising $50 \times 10^{-6}/1.6 \times 10^{-19}$ coul./electron $= 3 \times 10^{14}$ unit electronic charges across a 25 centimeter wide web. A 1 centimeter wide, 25 centimeter long web might typically carry a 150 $\mu$ thick liquid dispersion comprising 10 volume percent of pigment particles. This would place a volume of $150 \times 10^{-4}$ cm. $\times$ 25 cm. $\times 0.1 = 3.7 \times 10^{-2}$ cm.$^3$ of pigment into the corona zone at any given moment. At a coating rate of 10 centimeters/second, the pigment will spend an average time of 0.1 second in the corona zone and $3.7 \times 10^{11}$ particles/sec. will pass through the corona charging zone.

The corona current of $3 \times 10^{14}$ unit ionic charges/second allows about $2 \times 10^4$ charges to impinge per particle per second, or nearly 1000 unit electronic charges per particle during the time the particle spends in the corona zone. Approximately 10 unit charges/particle have been found to be sufficient to drive the particle through a typical coating slurry to the grounded electrode. Therefore, the ionic charge furnished by the electrode exceeds by a factor of about 100 the minimum of charges required to drive all the particles to the base electrode. Thus, even though a large fraction of the ion current must pass directly through the solution to the base electrode, by-passing the particles, there is ample charge available to deposit the particles on the base. This mechanism is believed to account for the high efficiency of the electrodeposition process of the instant invention.

As will be recognized by those skilled in the art, in order to provide an operable photoreceptor, it is necessary that there be a blocking layer between the conductive substrate and photoconductor to prevent charge injection from the substrate during the charging step. Where the substrate surface is naturally blocking as in the situation where substantial amounts of energy are required to promote charge carriers from the substrate into the photoreceptor body, no additional blocking material is required. Where a distinct blocking layer is required, a separate layer is applied to the substrate which is depicted as blocking interface 12 in the drawings. Typical blocking materials may be employed in thicknesses from about 30 A to 1.0 (preferably 0.01 to 0.3) micron and include nylon, epoxies, aluminum oxide (as in the case of an aluminum substrate whose surface has been oxidized) and insulating resins of various types including polystyrene, butadiene polymers and copolymers, acrylic and methacrylic polymers, vinyl resins, alkyd resins and cellulose base resins. When an organic material is used as the blocking layer, it will be necessary to choose a non-solvent for this organic material as the solvent for the organic overcoating material.

The invention is further illustrated by the following examples.

EXAMPLE I

Twelve grams of Luvican polymer [BASF brand of poly(vinylcarbazole)] is dissolved in 120 milliliters chloroform. Next, 0.8 grams of finely divided amorphous selenium powder is added to the solution and dispersed by means of a vigorous counter-current laboratory stirrer and then stirred more slowly for 10 hours until the pigment has been re-crystallized substantially to red trigonal selenium particles approximately 1–2 $\mu$ in length and less than 0.1 $\mu$ in cross section. Such particles have been described in co-pending application Ser. No. 669,915. The resulting slurry is coated on a 6 by 8 inch sheet of 5 mil thick aluminum having an approximately 200 A thick oxide coating which serves as an effective dielectric barrier layer against dark charge injection. A 3 inch wide Bird coater (Gardner Laboratories) is used as the coating device, and is set to produce a 150 $\mu$ thick wet film in which the selenium particles are fairly uniformly dispersed. The sheet is set into the charging chamber of a Xerox Model D processor wherein a scorotron set at +6 KV for the central charging wire and at +500 V on the screen wires is passed over the sheet at approximately 3 inches per second and at a distance from the liquid layer of 0.3 inches, whereupon the sheet is removed. The selenium particles are now found to be firmly deposited on and adherent to the oxide covered aluminum base with a clear solution of poly(vinylcarbazole) in chloroform above this layer. The chloroform is allowed to evaporate, after which the coated plate is stored for 6 hours in a vacuum desiccator (at 150° C. and 0.5 torr) in order to remove all traces of solvent residue. The plate is removed from the desiccator and found to consist of a strongly adherent double layered coating comprising an approximately 0.25 $\mu$ thick layer of poly(vinylcarbazole) bound selenium particles overcoated by a 15 $\mu$ transparent overcoating of poly(vinylcarbazole).

The resultant photoreceptor may now be used in the conventional xerographic mode. To accomplish this, the photoreceptor is charged negatively, photodischarged imagewise by approximately 5 ergs/cm.$^2$ of white tungsten radiation and the resultant image developed by standard xerographic techniques using the Xerox reversal developer. After toner transfer, the plate is photodischarged completely, wiped clean by cotton and re-used.

EXAMPLE II

Four grams of triphenylamine (Eastman Cat. 1907) and 3.0 grams of 2,4,7-trinitro-9-fluorenone (Eastern Chemical Co.) are dissolved with 10.0 grams of Lexan 125 polycarbonate resin (General Electric) in a solvent consisting of 150 grams dichloroethane, 60 grams toluene and 20 grams cyclohexanone. Two grams of the X-form of metal free phthalocyanine in the 1 to 2 micron particle size range are added and dispersed by means of a high speed counter rotating mixer. The resulting slurry is Bird coated on a sheet of tin oxide coated glass (NESA glass, PPG Industries) as a 150 micron thick, 3 inch wide layer. The sheet bearing the still wet coating is passed under a 5 inch wide corona wire at +6 KV, located about 3 inches above the coating, with a mask interposed to limit the corona discharge to a 1 centimeter long, 5 inch wide slot. The conductive coating of the NESA plate is carefully grounded during this process by means of a strip of metal foil. The corona treatment precipitates a dense, blue charge-carrier generating layer of phthalocyanine at the tin oxide electrode above which there remains a yellowish transparent film of resin solution. Upon removal of the solvent, a 1 micron thick phthalocyanine pigment "generating" layer is formed at the tin oxide electrode covered by a 10 micron resinous "active" transport layer. After 6 hours storage at 110°C., in a vacuum desiccator at 0.5 torr, the plate is ready for xerographic use.

The plate is tested for xerographic response by charging to positive or negative 500 V, and is found to respond to image exposure of approximately 12 ergs/cm.$^2$ tungsten radiation (color temperature 2850°K.). The spectral response is maximal between 600 and 750 millimicrons.

EXAMPLE III

The procedure of Example I is repeated with cadmium sulfoselenide as photogenerating pigment and a charge transfer complex formed by 80 mole percent (based on carbazole units) of poly(vinylcarbazole) and 20 mole percent of 2,4,7-trinitro-9-fluorenone serving as transport matrix. The initial slurry comprises 2.0 grams of CdSSe (Ferro Corporation) dispersed in a 220 milliliters of a 1:1 (by volume) tetrahydrofuran:-chloroform solution of 20.0 grams Luvican PVK (BASF) and 1 gram of TNF (Eastern Chemical Co.). The slurry is coated to a thickness of about 180 $\mu$.

Negative corona is found to be more effective than positive corona for the deposition of this particular pigment. After pigment deposition and solvent removal, the dry coating comprises an approximately 2.0 $\mu$ layer of brown photoconductive pigment overlaid by about a 20 $\mu$ thick layer of the PVK:TNF charge transfer complex.

The photoreceptor so prepared, whose photosensitivity is panchromatic, is charged to +500 V and photodischarged with approximately 5 ergs/cm.$^2$ of white light. Conventional "Xerox-Type 10" developer may be used to form and transfer positive images. The plate can be erased, cleaned and recycled numerous times.

The invention has been described and exemplified for the preparation of a photoreceptor having a layer of an organic active transport material over the photoconductive layer. As previously mentioned, a photoreceptor comprised of an organic insulating material overcoating the photoconductive material can be prepared in a similar manner. The characteristic required for the organic insulating material, when one is used, is that it have sufficiently high resistivity to retain an electrostatic charge. In addition, the organic overcoating material, whether it be of the active transport or insulating variety, preferably has a fairly high resistance to abrasion. Suitable insulating materials include polycarbonate resins, acrylic resins, cellulose acetate resins and polyester resins.

Figure 4:
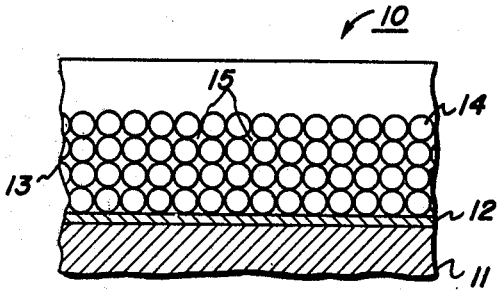

When an insulating resin is used, sufficient photoconductive material should be dispersed in the slurry to provide a finished photoreceptor of the configuration depicted in FIG. 4 upon forced precipitation of the photoconductor. This is the case because particle to particle contact of the photoconductor will be essential in this embodiment. In addition, the insulating layer should be relatively thin in order to function in the desired manner.

What is claimed is:

1. An improved method for the preparation of an electrostatographic photoreceptor comprised of a layer of an organic active transport material which comprises a polymer or non-polymeric material capable of supporting the injection of photoexcited holes or transporting electrons and allowing the transport of the holes or electrons through the layer to selectively dissipate a charge on the surface of the layer or an organic insulating material which is selected from those materials which have sufficiently high resistivity to retain an electrostatic charge overcoating a photoconductive, charge carrier generating material in operative connection with a conductive substrate which comprises:

a. selecting at least one organic active transport or insulating material and at least one pigmentary photoconductive material selected from those organic or inorganic photoconductors which are capable of the photogeneration of hole-electron pairs;

b. preparing a substantially uniform liquid dispersion containing the pigmentary photoconductive material as dispersed phase and the organic, active transport or insulating material in solution with a solvent therefore as carrier phase;

c. uniformly coating the dispersion onto a grounded conductive substrate in such a manner that the buildup of electrostatic fields in the dispersion is avoided;

d. exposing the liquid coating to a direct stream of corona ions or a high intensity DC electric field, without contacting its surface with an electrode, in order to cause separation of the two phases into a two layered structure with the layer of photoconductive material being deposited between the substrate and the organic material in solution; and e. drying the layered structure by removing the solvent.

2. The method of claim 1 wherein the organic material is an active transport material of the electron donor type.

3. The method of claim 2 wherein the organic active transport material comprises carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; triphenylamine; azapyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene); poly(vinylperylene) or a mixture thereof.

4. The method of claim 1 wherein the organic material is an active transport material of the electron acceptor type.

5. The method of claim 4 wherein the organic active transport material comprises 2,4,7-trinitro-9-fluorenone; 2,4,5,7-tetranitrofluorenone; dinitroanthracene; dinitroacridene; tetracyanopyrene; or dinitroanthraquinone.

6. The method of claim 1 wherein the photoconductive material is inorganic.

7. The method of claim 6 wherein the inorganic photoconductive material is cadmium sulfide, cadmium sulfoselenide, cadmium selenide, crystalline or amorphous selenium, lead oxide or mixtures thereof.

8. The method of claim 1 wherein the photoconductive material is organic.

9. The method of claim 8 wherein the organic photoconductive material is the X-form of metal free phthalocyanine, a metal phthalocyanine, bis-benzimidazole, a perylene pigment, a quinacridone pigment, or an indigoid pigment.

10. The method of claim 1 wherein the organic material comprises poly(vinylcarbazole) and the photoconductive material is trigonal selenium.

11. The method of claim 1 wherein the organic material comprises a mixture of poly(vinylcarbazole) and 2,4,7-trinitro-9-fluorenone and the photoconductive material is the X-form of metal free phthalocyanine.

12. The method of claim 1 wherein the organic material comprises 2,4,7-trinitro-9-fluorenone in a polycarbonate resin and the photoconductive material is cadmium sulfoselenide.

13. The method of claim 1 wherein the organic material comprises 2,4,7-trinitro-9-fluorenone in a polycarbonate resin and the photoconductive material is the X-form of metal free phthalocyanine.

14. The method of claim 1 wherein the corona ions are supplied by a corotron or scorotron device.

15. The method of claim 1 wherein the conductive substrate comprises brass, aluminum, steel, an aluminized polymer or a conductively coated dielectric or insulator.

16. The method of claim 1 wherein the substrate comprises a polymer film or glass coated with a layer of aluminum, chromium or tin oxide.

17. The method of claim 1 wherein the organic material is an insulating resin.

18. The method of claim 17 wherein the insulating resin comprises a polycarbonate resin, an acrylic resin, a cellulose acetate resin or a polyester resin.

19. The method of claim 1 wherein an inert, polymeric binder material is added to the solvent along with the organic active matrix material in an amount such that removal of the solvent provides a layer in which the active transport material is dissolved or dispersed in the binder material with the active transport material being present in an amount of over 30 volume percent.

20. The method of claim 19 wherein the inert polymeric binder material comprises a polycarbonate, an acrylate polymer, a poly amide, a polyester, a polyurethane or a cellulose polymer.

* * * * *